US008668958B2

(12) United States Patent
Bouvier et al.

(10) Patent No.: US 8,668,958 B2
(45) Date of Patent: Mar. 11, 2014

(54) MASCARA APPLICATOR BRUSH HAVING GERMICIDAL PROPERTIES, AND PRODUCTION METHOD THEREOF

(71) Applicant: Strand Cosmetics Europe, Dardilly (FR)

(72) Inventors: Dominique Bouvier, Lyons (FR); Emmanuelle Couval, Rillieux la Pape (FR); Gaelle Bouland, Villeurbanne (FR); Christelle Darier, Villeurbanne (FR); Aurélie Gervon, Aubiat (FR)

(73) Assignee: Strand Cosmetics Europe, Dardilly (FR)

( * ) Notice: Subject to any disclaimer, the term of this patent is extended or adjusted under 35 U.S.C. 154(b) by 0 days.

(21) Appl. No.: 13/832,600

(22) Filed: Mar. 15, 2013

(65) Prior Publication Data

US 2013/0221730 A1 Aug. 29, 2013

Related U.S. Application Data

(60) Division of application No. 11/373,939, filed on Mar. 13, 2006, now Pat. No. 8,424,147, which is a continuation of application No. PCT/FR2004/050417, filed on Sep. 8, 2004.

(30) Foreign Application Priority Data

Sep. 17, 2003 (FR) ..... 03 50559

(51) Int. Cl.
*B05D 3/02* (2006.01)

(52) U.S. Cl.
USPC ..... 427/352; 427/353; 427/354; 427/384

(58) Field of Classification Search
None
See application file for complete search history.

(56) References Cited

U.S. PATENT DOCUMENTS

| | | | | |
|---|---|---|---|---|
| 2,535,077 | A | | 12/1950 | Kunz |
| 3,062,379 | A | | 11/1962 | Bryan |
| 3,281,263 | A | | 10/1966 | Priesing |
| 4,871,536 | A | | 10/1989 | Arraudeau et al. |
| 5,622,708 | A | | 4/1997 | Richter et al. |
| 5,657,777 | A | | 8/1997 | Guttag |
| 5,974,619 | A | * | 11/1999 | Weihrauch ..... 15/186 |
| 6,026,824 | A | * | 2/2000 | Gueret ..... 132/218 |
| 6,269,514 | B1 | | 8/2001 | Edwards et al. |
| 6,503,952 | B2 | | 1/2003 | Modak et al. |

(Continued)

FOREIGN PATENT DOCUMENTS

| | | | |
|---|---|---|---|
| DE | 34 38 186 | A1 | 4/1986 |
| JP | 03-289905 | A1 | 12/1991 |
| WO | WO 93/16618 | A1 | 9/1993 |
| WO | WO 99/35911 | A1 | 7/1999 |

*Primary Examiner* — Erma Cameron
(74) *Attorney, Agent, or Firm* — Burr & Brown, PLLC

(57) ABSTRACT

A mascara applicator brush is provided, including polymer bristles which are coated with a germicidal composition. The aforementioned composition is made from a mixture based on at least one large cation and at least one large anion, in which one or both develop germicidal properties.

3 Claims, 2 Drawing Sheets

(56) References Cited

U.S. PATENT DOCUMENTS

| | | | | |
|---|---|---|---|---|
| 2001/0033854 | A1 | 10/2001 | Johnson et al. | |
| 2002/0004964 | A1 | 1/2002 | Luchino et al. | |
| 2002/0005209 | A1* | 1/2002 | Gueret | 132/218 |
| 2003/0039673 | A1 | 2/2003 | Shanbrom | |
| 2003/0163884 | A1* | 9/2003 | Weihrauch | 15/207.2 |
| 2004/0116551 | A1 | 6/2004 | Terry | |
| 2004/0117930 | A1 | 6/2004 | Townley et al. | |
| 2004/0132907 | A1 | 7/2004 | Nakamura et al. | |
| 2004/0240926 | A1* | 12/2004 | Gueret | 401/122 |
| 2006/0127338 | A1 | 6/2006 | Morita et al. | |

* cited by examiner

MASCARA APPLICATOR BRUSH HAVING GERMICIDAL PROPERTIES, AND PRODUCTION METHOD THEREOF

CROSS-REFERENCE TO RELATED APPLICATIONS

This application is a divisional of U.S. patent application Ser. No. 11/373,939, filed Mar. 13, 2006, now U.S. Pat. No. 8,424,147, which in turn is a continuation of International Patent Application No. PCT/FR2004/050417, filed Sep. 8, 2004, and claims the benefit under §119(a)-(d) of French Patent Application No. 03 50559, filed Sep. 17, 2003, the entireties of which are incorporated herein by reference.

FIELD OF THE INVENTION

The invention relates to a brush having germicidal properties for applying mascara.

BACKGROUND OF THE INVENTION

Mascara is a cosmetic product used to color and/or thicken eyelashes. This composition is applied to the eyelashes with a brush that is traditionally attached to the plug that seals the bottle containing the mascara composition. In doing this, once the bottle is first opened, successive applications of the mascara with this brush and reinserting the brush into the bottle containing the mascara itself thus leads to a risk of contamination of the cosmetic composition with germs, and notably bacteria or fungi (i.e., germs picked up by the brush when in contact with the user's skin or eyelashes). These germs enter into the cosmetic composition, thus leading to a relatively fast termination of the mascara's usability, in fact requiring that it should be discarded relatively quickly in order to limit the possible risks of the multiplication of these germs in the mascara, in any case well before the cosmetic composition is used up.

To remedy this disadvantage, it has long been suggested that the mascara composition should contain preservatives, i.e. additives which can avoid and at least limit the growth of these germs. It has been shown, however, that such preservatives are irritants and can cause reactions in the eye, very close to the area where the mascara is applied. Moreover, the use of such preservatives can lead to the creation of resistant bacterial strains which can develop in the eye, risking the accompanying pathological consequences.

In a related field, concerning oral hygiene, the proposal has been made, notably in document WO 99/35911, to produce a toothbrush whose bristles are made of a plastic material containing a compound with antimicrobial activity, the component notably comprising a halogenated hydrocarbon, notably triclosan.

Experience has shown, however, that while germicidal activity can indeed be demonstrated, the salting out of this antimicrobial compound is observed, notably in the oral cavity. While such salting out has no effects, or at least no harmful effects, in toothbrush applications, it is unacceptable in the case of mascara, where such salting out would occur in the cosmetic composition itself, which could affect its composition and, furthermore, would not provide any increase in the duration of use of the mascara applicator brush.

SUMMARY OF THE INVENTION

Indeed, the object of the present invention is, on the one hand, to increase the useful lifetime of the mascara applicator brush, and therefore to optimize the use-by date for such a product. The present invention also aims to decrease, as much as possible, the quantity of preservatives included in the cosmetic composition, avoiding the salting out of the germicide in the mascara as much as possible.

In the following description and claims, the term "large anion" refers to an anion selected from the group consisting of:

- anions of the carboxylate (oleate, for example) or alkyl sulphate (lauryl sulphate, for example) type, with an alkyl chain having a number of carbons greater than 10;
- polyanions of the polycarboxylate type (polyacrylate, for example); or
- other anions of the silicate or polyphosphate type.

In the following description and claims, the term "large cations" refers to a cation selected from the group consisting of:

- quaternary ammoniums bearing at least one alkyl chain having a number of carbons greater than 8;
- cationic polymers of the ammonium polyacrylate type;
- polyiminium hydrochlorides and notably polyhexamethylene biguanide (PHMB); and
- polymers bearing quaternary ammonium functions and notably quaternary polyammoniums.

The present invention provides a mascara applicator brush comprising polymer bristles coated with a germicidal composition produced using a mixture including at least one large cation and at least one large anion, one or the other or both developing germicidal properties.

Implementation of this particular mixture thus allows a compound with germicidal properties to bind to the bristles on the brush, experience showing that it is not salted out into the mascara. At the same time, this compound provides the satisfactory development of germicidal properties and in all cases in compliance with the goal sought by the present invention.

Advantageously, the polymer constituting the bristles of the brush is a polyamide, and preferably polyamide 6.12.

It is possible, however, to envisage implementing a synthetic polymer chosen from the group including polyurethane, polyethylene, polypropylene, polyester, polyacrylic, modacrylic, alone or in mixtures.

The polymer constituting the bristles of the brush can also be an artificial or natural polymer.

According to another aspect of the invention, the cation implemented comes from a polyiminium salt (hydrochloride, for example), and notably polyhexamethylene biguanide, more commonly known as PHMB. This cation can also be made of a quaternary ammonium salt, notably quaternary polyammonium.

In one advantageous production method, the large anion is derived from a sodium polyacrylate salt, sodium silicate, sodium polyphosphate, sodium oleate or sodium lauryl sulphate.

The Applicant has observed that particularly interesting results can be obtained in terms of germicidal properties and the absence of salting out into the mascara when the composition of the invention combines sodium oleate and PHMB, advantageously in 50/50 mole proportions.

The present invention also relates to a method for depositing such a germicidal composition onto the mascara applicator brushes.

This method includes:

- performing cold soaking of the brush in a mixture of at least one large cation salt and at least one large anion salt, one or the other or both having germicidal properties;

then performing a rinsing step to eliminate excess substance not bound to the bristles of the brush; and then performing a drying step to eliminate the water contained in the brushes.

In other production methods, the anion and cation salts can be mixed successively, one before the other and vice-versa.

DETAILED DESCRIPTION OF THE INVENTION

Figure 1:
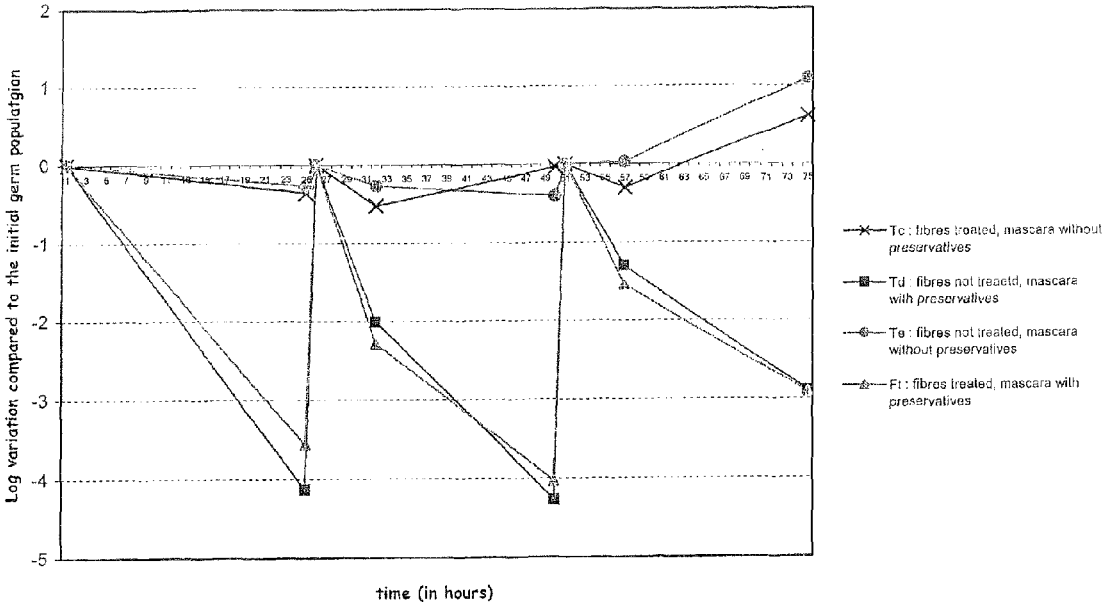
FIGS. 1 and 2 represent an illustrative graph of the germicidal action of the composition of the invention against *Escherichia coli* CIP 53.126 under normal conditions of use.

The present invention and its advantages can be seen in the following examples, and are supported by the appended drawing figures.

Example 1

Preparation of Brushes with Germicidal Properties 5300 brushes, produced using polyamide 6.12 bristles with a diameter of 80 micrometers (representing a weight of 1500 grams) are placed in 10 liters and treated as follows:

Prepare 4.5 kg of a solution of sodium oleate at 0.69 wt. %: dissolve 31.05 g pure sodium oleate in approximately 500 ml warm soft water, fill to 4.5 kg with cold soft water.

Prepare 4.5 kg of a solution of Cosmocil CQ (PHMB sold by Avecia at 20% by weight in water) at 0.5% by weight: dissolve 112.5 g Cosmocil CQ (at 20% in water) in 500 ml cold soft water; fill to 4.5 kg with cold soft water.

Add the 4.5 kg of Cosmocil CQ solution at 0.5% into the reactor (total volume of liquid: 9 liters for a bath ratio of 6).

Stir the bath.

Add the 4.5 kg of sodium oleate solution at 0.69% into the reactor while stirring.

Continue stirring.

The brushes are removed from the reactor, then rinsed in soft water and dried.

The weight increase of the brushes is 1.84%.

Example 2

Microbiological Results of the Brush Treated According to the Invention with Mascara Absent The purpose of this example is to test the germicidal properties of the composition of the invention when applied according to the method in example 1 to various types of fibres constituting a mascara brush.

The composition tested is the following:

COSMOCIL CQ® bactericide manufactured by AVECIA in a 20% solution: $—((CH_2)_3—NH—CNH—NH—CNH—NH—(CH_2)_3C)_n—HCl$, n=16 anion: SODIUM OLEATE manufactured by RIEDEL DEHAEN: $CH_3(CH_2)_7CH{=}CH(CH_2)_7CO_2NaC_{17}H_{33}CO_2Na$=304.4

The composition of the invention is applied to three different types of brushes, respectively:

1. polyamide 6.12
2. polyamide 6.6
3. polyamide 6 (two origins)

In practice, each brush sample is immersed in the COSMOCIL CQ/SODIUM OLEATE solution stirred for several hours at ordinary temperature. The bath ratio, liquid mass/brush mass, is between 3 and 10 (more advantageously, 6). The brushes are rinsed, centrifuged and dried.

For samples corresponding solely to the STRAND 14 and STRAND 14R references in polyamide 6.12, the brushes are previously rinsed in hot water and dried at 80° C.

The treated brushes are, depending on the case, post-treated by rinsing with soft water, whether cold or not.

The dry matter content of each tested sample is represented in the following table:

TABLE 1

| Results | | | | | |
|---|---|---|---|---|---|
| Samples | Support | Pre-treatment | Molar ratio | Post-treatment | Dry matter content |
| Strand 14 | PA 6.12 | Rinse with water and dry at 80° C. | l/l | | 2.04% |
| Strand 14R | | | l/l | rinsed | 2.04% |
| A2 | PA 6.12 | | l/l | | 4.46% |
| B2 | PA 6.6 | | l/l | | 5.02% |
| C2 | PA 6 Ref. A | | l/l | | 4.93% |
| D2 | PA 6 Ref. B | | l/l | | 3.96% |
| A2R | PA 6.12 | | l/l | rinsed | 3.42% |
| B2R | PA 6.6 | | l/l | rinsed | 3.11% |
| C2R | PA 6 Ref. A | | l/l | rinsed | 3.05% |
| D2R | PA 6 Ref. B | | l/l | rinsed | 6.36% |

The following microbiological test was then performed on each sample: The fibres are placed in suspension in the peptone broth contaminated with five different germs:

*Escherichia coli* CIP 53.126 (for STRAND 14 and STRAND 14R only)

*Staphylococcus aureus* CIP 4.83 (except for STRAND 14 and STRAND 14R samples)

*Pseudomonas aeruginosa* CIP 82.118 (except for STRAND 14 and STRAND 14R samples)

*Candida albicans* IP 48.72 (except for STRAND 14 and STRAND 14R samples)

*Aspergillus niger* IP 1431.33 (except for STRAND 14 and STRAND 14R samples)

The evolution of contamination is measured for the bacteria every day for one week and at D+1, D+5 and D+7 for yeasts and moulds. Values are given in CFU/ml. Each test is performed in triplicate.

The results are given in tables 2 to 6 below.

TABLE 2

| *Escherichia coli* CIP 53.126 | | |
|---|---|---|
| Time | STRAND 14 | STRAND 14R |
| D0 | $1.67 \times 10^5$ | $1.60 \times 10^5$ |
| D + 1 | <2 | <2 |
| D + 2 | <2 | <2 |
| D + 5 | <2 | <2 |
| D + 6 | <2 | <2 |
| D + 7 | <2 | <2 |
| D + 8 | <2 | <2 |

TABLE 3

| *Staphylococcus aureus* CIP 4.83 | | | | | | | | |
|---|---|---|---|---|---|---|---|---|
| Time | A2 | A2R | B2 | B2R | C2 | C2R | D2 | D2R |
| D0 | $2.8 \times 10^4$ | $3.0 \times 10^4$ | $4.0 \times 10^4$ | $3.7 \times 10^4$ | $7.0 \times 10^4$ | $6.0 \times 10^4$ | $5.1 \times 10^4$ | $8.4 \times 10^4$ |
| D + 1 | <2 | <2 | <2 | <2 | <2 | <2 | <2 | <2 |
| D + 2 | <2 | <2 | <2 | <2 | <2 | <2 | <2 | <2 |
| D + 5 | <2 | <2 | <2 | <2 | <2 | <2 | <2 | <2 |
| D + 6 | <2 | <2 | <2 | <2 | <2 | <2 | <2 | <2 |

TABLE 4

| *Pseudomonas aeruginosa* CIP 82.118 | | | | | | | | |
|---|---|---|---|---|---|---|---|---|
| Time | A2 | A2R | B2 | B2R | C2 | C2R | D2 | D2R |
| D0 | $2.8 \times 10^4$ | $2.4 \times 10^4$ | $3.2 \times 10^4$ | $3.3 \times 10^4$ | $5.0 \times 10^4$ | $5.7 \times 10^4$ | $4.6 \times 10^4$ | $7.9 \times 10^4$ |
| D + 1 | <2 | $2.2 \times 10^2$ | <2 | $9.5 \times 10^2$ | $3.0 \times 10^2$ | $2.6 \times 10^2$ | <2 | 13 |
| D + 2 | <2 | $2.4 \times 10^3$ | <2 | $1.6 \times 10^3$ | $1.8 \times 10^3$ | $1.0 \times 10^3$ | <2 | $4.4 \times 10^2$ |
| D + 5 | <2 | $2.5 \times 10^2$ | $3.7 \times 10^2$ | $6.4 \times 10^3$ | $3.8 \times 10^5$ | $1.9 \times 10^4$ | <2 | $9.5 \times 10^3$ |
| D + 6 | <2 | <2 | <2 | <2 | <2 | <2 | <2 | <2 |

TABLE 5

| *Candida albicans* IP 48.72 | | | | | | | | |
|---|---|---|---|---|---|---|---|---|
| Time | A2 | A2R | B2 | B2R | C2 | C2R | D2 | D2R |
| D0 | $2.8 \times 10^4$ | $4.1 \times 10^4$ | $5.1 \times 10^4$ | $4.7 \times 10^4$ | $4.2 \times 10^4$ | $4.5 \times 10^4$ | $4.5 \times 10^4$ | $4.4 \times 10^4$ |
| D + 1 | <2 | <2 | <2 | <2 | <2 | <2 | <2 | <2 |
| D + 5 | <2 | <2 | <2 | <2 | <2 | <2 | <2 | <2 |
| D + 6 | <2 | <2 | <2 | <2 | <2 | <2 | <2 | <2 |

TABLE 6

| *Aspergillus niger* IP 1431.33 | | | | | | | | |
|---|---|---|---|---|---|---|---|---|
| Time | A2 | A2R | B2 | B2R | C2 | C2R | D2 | D2R |
| D0 | $1.6 \times 10^4$ | $1.5 \times 10^4$ | $2.1 \times 10^4$ | $3.8 \times 10^4$ | $1.7 \times 10^4$ | $2.6 \times 10^4$ | $4.0 \times 10^4$ | $2.2 \times 10^4$ |
| D + 1 | <2 | <2 | <2 | <2 | <2 | <2 | <2 | <2 |
| D + 5 | <2 | <2 | <2 | <2 | <2 | <2 | <2 | <2 |
| D + 6 | <2 | <2 | <2 | <2 | <2 | <2 | <2 | <2 |

We observe that the STRAND 14 (not rinsed) and STRAND 14R (rinsed) samples are effective against *Escherichia coli* CIP 53.126.

We also observe that samples A2, B2, C2 and D2 present good antibacterial and antifungal activity. Indeed, we observe a rapid decrease: count lower than 2 CFU/ml in 24 hours.

Against the *Pseudomonas aeruginosa* CIP 82.118 strain, samples A2 and D2 present good antibacterial activity, since a rapid decrease is observed to a threshold under 2 CFU in 24 hours. Likewise, samples B2 and C2 present good antibacterial activity in 6 days, since the decrease reaches a threshold under 2 CFU/ml.

Measurement of the Salting Out of the Germicidal Composition into the Mascara

This measurement of salting out into the mascara is performed under normal conditions of use, i.e. at the level of the actual cosmetic compound contained in the bottle. It consisted in quantifying or detecting the bactericidal matter, COSMOCIL®, bound to the bristles of the brush according to the method previously described.

For this, the brushes are placed in contact continuously for 8 days at ambient temperature and at 40° C. Negative controls and COSMOCIL® (20% solution) are used to calibrate the measurement device used.

The various measurements made show that, in all cases, detection is below 0.003%.

Example 3

Measurement of the Antimicrobial Activity of PURCILON® Fibres Mounted on a Brush Under Real Conditions of Use In this example, we verify the antimicrobial activity of fibres treated with PURCILON® mounted on a brush under real conditions of use, i.e. for mascara.

Composition of PURCILON®: Polyamide 6.12 with 4.7% dry material content (similar to the A2R reference) treated according to the method described above on 1000 brushes.

Material and Method

Mascara Base

The base formula chosen is black water-resistant mascara with the following preservative system:

| | |
|---|---|
| Ethyl para-hydroxybenzoate (E POB) | 0.20% |
| Methyl para-hydroxybenzoate (M POB) | 0.10% |
| Propyl para-hydroxybenzoate (P POB) | 0.155% |
| Benzyl alcohol, methyl-4-hydroxybenzoate, propyl-4-hydroxybenzoate | 0.50% |

This base also contains matter that can facilitate the action of the preservatives such as:

| | |
|---|---|
| Tetrasodium salt of ethylenediaminetetraacetic acid (EDTA) | 0.10% |
| Glycerine, water, 1,2-octanediol, PEG-8, sodium polyacrylate | 3% |
| Butylene glycol | 1% |

The preservative was validated according to criteria B of the European pharmacopoeia.

Strains

The protective power of the mascara was studied for the following microbial strains:

*Escherichia coli* CIP 53.126

*Staphylococcus aureus* CIP 4.83

The strains are maintained by deep freezing. They are used after Trypcase soy agar subculturing.

Experimental Protocol

Controls and Trials Performed

The trials performed with the treated fibres and mascara with preservatives are called Ft trials.

At the same time, controls are made using the same protocol:

Ta: treated, non-contaminated fibres placed in contact with mascara without preservatives, which is used to verify the cleanliness of the treated fibres as well as that of the small bottles.

Tb: non-treated, non-contaminated fibres placed in contact with mascara without preservatives, which is used to verify the cleanliness of the non-treated fibres as well as that of the small bottles.

Tc: treated, contaminated fibres placed in contact with mascara without preservatives, which is used to verify the real incidence of the bactericidal effect of the treated fibres.

Td: non-treated, contaminated fibres placed in contact with mascara containing preservatives, which is used to verify the incidence of the preservative system in the mascara on decreasing the germ concentration.

Te: non-treated, contaminated fibres placed in contact with mascara without preservatives.

The principle consists in contaminating the brushes by soaking them in a germ solution and then inserting them into the small mascara bottles containing 6 grams of the Cilpur® formula and then monitoring the evolution of the contamination over time.

Each stock solution of germs is placed in the empty small bottles which are previously decontaminated with gamma rays. The diaphragm in the bottle provides a good calibration of the volume retained on the brush (estimated volume: 0.0708 ml over 10 trials).

The protective power of the fibres was studied using:

two stock solutions of *E. coli* calibrated to obtain an initial contamination of approximately $10^8$ CFU/ml for S1 and $10^7$ CFU/ml for S2.

one stock solution of *S. aureus* calibrated to obtain an initial contamination of approximately $10^5$ CFU/ml.

To evaluate the initial quantity of germs, the brush is used to retrieve:

for *E. coli*, 0.5 g±0.05 g mascara in 9 ml Eugon LT100 (neutralising diluent).

for *S. aureus,* 0.25 g±0.01 g mascara in 9 ml Eugon LT100.

Then, 0.5 ml of each sample is inoculated. The agars are then incubated at 30-35° C. The small bottles are sealed with the brushes and stored at 20-25° C.

Checks Performed on *E. coli:*

The bottles are checked after 24 hours of contact time for the first contamination. Two other overcontaminations are then performed on the same mascara bottles with the same brushes and checks on the evolution of contaminations are performed after 6 hours and 24 hours of contact.

Checks Performed on *S. aureus:*

The bottles are checked after 1, 2 and 6 hours of contact for the first two contaminations. For the third overcontamination, the checks are performed after 1, 2, 6 and 24 hours of contact.

All trials and controls are performed in triplicate as are the agar inoculation, which makes it possible to perform a statistical assessment of the results and to eliminate abnormal values.

Results and Discussion

Populations are determined using the results of viable germ counts. After eliminating the abnormal values, an average of the various trials is calculated.

*Escherichia coli:*

Figure 2:
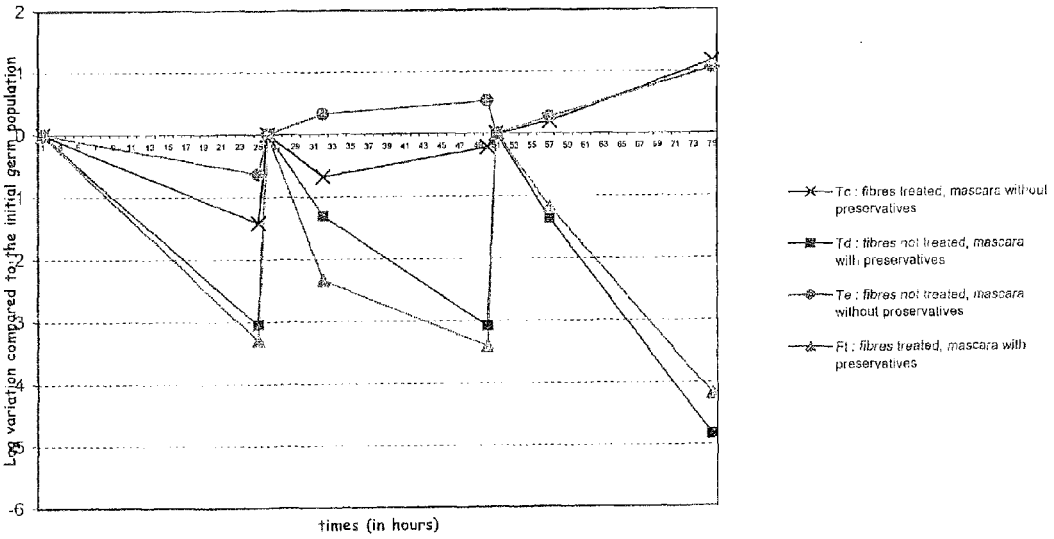

The trials performed with solutions S1 and S2 are fairly similar as can be seen in FIGS. 1 and 2.

A sharp decrease in germs is observed for trials Td and Ft (approximately 2 log in 6 hours). Comparison with the results obtained for trials Tc and Te can be used to determine that this log reduction is directly linked to the action of the preservatives present in the mascara.

Trials Td and Ft, notably with solution S2, demonstrate an improvement in the log reduction when the action of the preservatives in the mascara is combined with those present in the treated fibres. The smaller the initial population of viable germs, the greater this improvement. Trials Tc and Te back up this hypothesis of a synergistic action between the preservatives present in the mascara and in the treated fibres.

*Staphylococcus aureus:*

Figure 3:
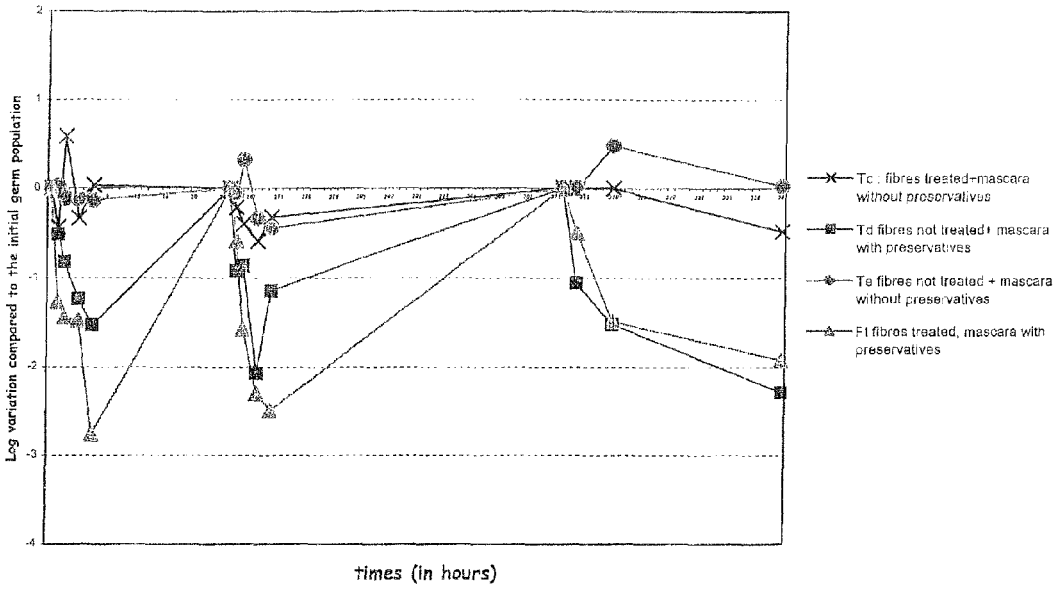
FIG. 3 represents an illustrative graph of the germicidal action of the composition of the invention against *Staphylococcus aureus* CTP 4.83 under normal conditions of use.

As was the case for *E. coli*, a sharp decrease in germs is observed for trials Td and Ft (FIG. 3). Comparison with the results obtained for trials Tc and Te can be used to determine that this log reduction is directly linked to the combined action of the preservatives present in the mascara and the germicide present in the treated fibres.

The invention claimed is:

1. A method for depositing a germicidal composition on the bristles of a mascara applicator brush, comprising:

providing mascara applicator brush consisting of polymer bristles;

performing cold soaking of the brush in a mixture of at least one large cation salt and at least one large anion salt, at least one of which having germicidal properties, wherein the mixture forms a germicidal composition coating layer bound to each of the polymer bristles, so that the germicidal composition is not salted out from the coating layer;

then performing a rinsing step to eliminate excess substances not bound to the bristles of the brush; and then performing a drying step to eliminate water contained in the bristles;

wherein the cation of the at least one large cation salt is non-metallic and is selected from the group consisting of quaternary ammoniums bearing at least one alkyl chain having a number of carbons greater than 8, ammonium polyacrylate cationic polymers, polyiminium hydrochlorides, and polymers bearing quaternary ammonium functions; and wherein the anion of the at least one large anion salt is selected from the group consisting of carboxylate anions with an alkyl chain having a number of carbons greater than 10, alkyl sulphate anions with an alkyl chain having a number of carbons greater than 10, polycarboxylate polyanions, silicate anions and polyphosphate anions.

2. A method for depositing a germicidal composition on the bristles of a mascara applicator brush, comprising:

providing a mascara brush consisting of polymer bristles;

performing cold soaking of the brush in a solution of at least one large cation;

adding to the solution at least one large anion salt to form a mixture, wherein at least one of the large cation and the large anion salt has germicidal properties, and wherein the mixture forms a germicidal composition coating layer bound to each of the polymer bristles, so that the germicidal composition is not salted out from the coating layer;

then performing a rinsing step to eliminate excess substances not bound to the bristles of the brush; and then performing a drying step to eliminate water contained in the bristles;

wherein the at least one large cation is non metallic and is selected from the group consisting of quaternary ammoniums hearing at least one alkyl chain having a number of carbons greater than 8, ammonium polyacrylate cationic polymers, polyiminium hydrochlorides, and polymers bearing quaternary ammonium functions; and wherein the anion of the at least one large anion salt is selected from the group consisting of carboxylate anions with an alkyl chain having a number of carbons greater than 10, alkyl sulphate anions with an alkyl chain having a number of carbons greater than 10, polycarboxylate polyanions, silicate an ions and polyphosphate anions.

3. A method for depositing a germicidal composition on the bristles of a mascara applicator brush, comprising:

providing a mascara brush consisting of polymer bristles;

performing cold soaking of the brush in a solution of at least one large anion;

adding to the solution at least one large cation salt to form a mixture, wherein at least one of the large cation salt and the large anion has germicidal properties, and wherein the mixture forms a germicidal composition coating layer bound to each of the polymer bristles, so that the germicidal composition is not salted out from the coating layer;

then performing a rinsing step to eliminate excess substances not bound to the bristles of the brush; and then performing a drying step to eliminate water contained in the bristles;

wherein the cation of the at least one large cation salt is non-metallic and is selected from the group consisting of quaternary ammoniums bearing at least one alkyl chain having a number of carbons greater than 8, ammonium polyacrylate cationic polymers, polyiminium hydrochlorides, and polymers hearing quaternary ammonium functions; and wherein the at least one large anion is selected from the group consisting of carboxylate anions with an alkyl chain having a number of carbons greater than 10, alkyl sulphate anions with an alkyl chain having a number of carbons greater than 10, polycarboxylate polyanions, silicate anions and polyphosphate anions.

* * * * *